US006106188A

United States Patent [19]

Krautzig et al.

[11] Patent Number: 6,106,188

[45] Date of Patent: Aug. 22, 2000

[54] JOINT BETWEEN TWO JOINT PARTNERS, AND ITS USE

[75] Inventors: Joachim Krautzig, Widen; Hans Wettstein, Fislisbach, both of Switzerland

[73] Assignee: Asea Brown Boveri AG, Baden, Switzerland

[21] Appl. No.: 09/106,097

[22] Filed: Jun. 29, 1998

[30] Foreign Application Priority Data

Jul. 2, 1997 [DE] Germany ..... 197 28 085

[51] Int. Cl.[7] ..... F16B 2/00; F01D 5/30

[52] U.S. Cl. ..... 403/375; 403/28; 416/220 R

[58] Field of Search ..... 403/375, 373, 403/374.1, 404, 28, 29, 360; 416/219 R, 239, 248, 220 R

[56] References Cited

U.S. PATENT DOCUMENTS

| | | | |
|---|---|---|---|
| 2,729,422 | 1/1956 | Scharf | 416/219 R |
| 2,985,426 | 5/1961 | Hunter et al. | 416/219 R X |
| 3,045,968 | 7/1962 | Willis | 416/219 R |
| 3,922,109 | 11/1975 | Hagen | 416/219 R X |
| 4,191,509 | 3/1980 | Leonardi | 416/219 R |
| 4,692,976 | 9/1987 | Andrews | 416/219 R X |
| 4,824,328 | 4/1989 | Pisz et al. | 416/219 R |
| 5,110,262 | 5/1992 | Evans | 416/219 R |
| 5,160,242 | 11/1992 | Brown | 416/219 R X |
| 5,554,005 | 9/1996 | Nguyen | 416/219 R |

FOREIGN PATENT DOCUMENTS

| | | |
|---|---|---|
| 2485117 | 12/1981 | France . |
| 3133158C1 | 12/1982 | Germany . |
| 4215050A1 | 11/1993 | Germany . |
| 4435268A1 | 4/1996 | Germany . |
| WO87/00778 | 2/1987 | WIPO . |

*Primary Examiner*—Harry C. Kim

*Attorney, Agent, or Firm*—Burns, Doane, Swecker & Mathis, L.L.P.

[57] ABSTRACT

A joint between a first and a second joint partner where each joint partner has at least one flat, cylindrical surface section via which force is applied to the other joint partner. The joint partners being brought into contact with one another in a sliding fashion such that the flat, cylindrical surface sections of the joint partners partially overlap and form a common bearing surface in the contact region. The flat, cylindrical surface sections of the joint partners are each bonded on one side by an undercut and the joint partners are joined such that the common bearing surface of the joint partners is bounded in one direction by the undercut of the first joint partner and in the opposite direction by the undercut of the second joint partner. This arrangement allows zones of maximum stress gradient to be shifted into the region of the undercut structures and for crack-opening, surface-parallel stresses to be substantially avoided.

10 Claims, 5 Drawing Sheets

JOINT BETWEEN TWO JOINT PARTNERS, AND ITS USE

BACKGROUND OF THE INVENTION

Field of the Invention

The invention relates to a joint between two joint partners, which in each case have at least one flat, cylindrical or conical surface section via which force is applied to the joint partners and the latter can be brought into contact with one another in a sliding fashion in such a way that the flat, cylindrical or conical surface sections of the two joint partners overlap only partially and form a common bearing surface in the contact region.

Machine parts which abut one another under applied force and in a loose joint via mutual contact surfaces in a combined system experience in the course of normal material fatigue and as a consequence of transient or other differential movements superficial incipient cracks which can lead to the total failure of the machine parts through a further mechanical stress owing to crack growth.

Differential movements between machine parts occur, in particular, wherever the machine parts are subjected to vibrations or thermal loads. In the case of thermal loads, mutually adjacent materials with different thermal expansion responses are subject to relative movements as a consequence of being heated or cooled at different speeds, although the individual machine parts have been designed, for example, for a stationary application. Particularly in the case of alternating loads, which act unremittingly on machine parts when there are mechanical vibrations, but also in the case of changes in temperature, incipient microscopic cracks are formed perpendicular to the contact surface of the mutually abutting machine parts and can lead in further operation, because of prevailing alternating loads to crack growth into the predamaged material which is orientated normal to the contact surface.

DISCUSSION OF BACKGROUND

As outlined briefly above, as a rule the damage potential caused by the crack growth leads to the failure of corresponding structural elements, with the result that components damaged in this way must be exchanged through complicated maintenance work which is partly associated with high technical and financial outlays.

A typical example for the occurrence of superficial incipient cracks in structural machine parts respectively mutually adjacent are fastenings of turbine blades in a rotor casing, provided with blade suspensions, of a gas turbine arrangement. On their shaft, the individual turbine blades have so-called gripping pins which have a contour by means of which they are to be fastened to the rotor housing in a corresponding holding contour. In a way known per se, the holding contour on the rotor housing provides holding slots into which the gripping pin of each individual turbine blade can be inserted and which can be fixed on corresponding mechanical abutments which are provided in the holding slots.

FIG. 2*a* presents a diagrammatic example for representing the contact surface of a known mechanical abutment which is part of a holding slot. The joint partner 1, which corresponds, along the lines of the previously mentioned example, to the gripping pin part of a turbine blade, has a cylindrical surface section 11 via which the joint partner 1 is connected to a likewise cylindrical surface section 21 of a joint partner 2. In this case, the joint is constructed in such a way that the joint partners 1 and 2 can slide relative to one another, at least along the cylindrical surface section, as far as the thermal expansion differences, for example, require. In the case of the previously quoted example of the suspension of turbine blades in the rotor housing, the joint represented in FIG. 2*a* is subject not only to mechanical vibrations, which it is to withstand in conjunction with the application of strong forces and with high pressure stresses and tensile stresses, but also experiences strong thermal loading over a large temperature range ($\Delta T$ ca. 650° C.). As a consequence of the thermal loads and also of the mechanical loads, in the case of these typical joints as represented in FIG. 2*a,* incipient cracks arise in the material of the joint partners, which are provided in FIG. 2*b* with the reference symbols A1, A2. Such incipient cracks are enlarged as a consequence of further lasting alternating loads, which act on the joint partners 1 and 2, and of the mechanical stresses prevailing in the material, and finally lead to an irreversible macroscopic damage of the joint partners. The stress profile, represented in FIG. 2*c* in cross-section, of a joint, known along the lines of FIG. 2*a,* of two joint partners 1 and 2 illustrates that the occurrence of growing incipient cracks is more frequent in zones of maximum mechanical stress densities S1 and S2. The lines drawn in FIG. 2*c* rather as contour lines in the cross-sections of the joint partners 1 and 2 represent zones of equal stress values in each case. It is striking that the zones of maximum stress densities inside the flat surface sections in which the two joint partners touch one another occur near a contour transition of the joint partners. Moreover, a characteristic feature of such a stress distribution is the occurrence of tensile stresses outside the contact region of the two joint partners under specific operating conditions which favor the growth of incipient cracks which are once started.

In particular, the local overlapping of the zones of the maximum voltage gradient with the mechanical contact of the joint partner respectively situated opposite leads to a superficial crack-opening loading which is responsible for the further growth of the partly unavoidable so-called incipient fretting cracks.

SUMMARY OF THE INVENTION

Accordingly, one object of this invention is to further develop a joint between two joint partners, which in each case have at least one flat, cylindrical or conical surface section via which force is applied to the joint partners and the latter can be brought into contact with one another in a sliding fashion in such a way that the flat, cylindrical or conical surface sections of the two joint partners overlap only partially and form a common bearing surface in the contact region, doing so in such a way that the growth of superficial incipient cracks, which can lead as far as the total loss of a joint partner, is to be avoided. In particular, the joint is to permit the use of standard materials through appropriate shaping of the joint partners, and is to withstand both the mechanical and thermal loads, in particular when used in gas turbine engineering.

According to the invention, a joint between two joint partners, which in each case have at least one flat, cylindrical or conical surface section via which force is applied to the joint partners and the latter can be brought into contact with one another in a sliding fashion in such a way that the flat, cylindrical or conical surface sections of the two joint partners overlap only partially and form a common bearing surface in the contact region, is developed in such a way that the flat, cylindrical or conical surface sections of the joint partners are each bounded on one side by at least one undercut, and wherein the joint partners can be joined in such a way that the common bearing surface of the joint partners is bounded in one direction by the undercut of one joint partner and is bounded in the opposite direction by the undercut of the other joint partner.

The invention is based on the idea of using geometrical shaping of the joint partners in the joint region to change the mechanical stress profile inside the material in such a way that the zones of maximum mechanical loading, that is to say of the maximum stress gradient is shifted from the region of the bearing surface and, at the same time, to withdraw those zones of each joint partner in which, under specific operating conditions, it is possible for there to occur surface-parallel tensile stresses which open cracks, and thus promote crack growth, from the contact region of the respective other joint partner, so that no cracking incipient cracks can be produced. Furthermore, as a result of the inventive configuration of the overlapping of the front edge of the undercut of the respective other joint partner by an extension, exceeding the relative movements and installation tolerances to be expected, of the contact surfaces of the two joint partners, under the abovementioned operating conditions only surface-parallel pressure stresses which close cracks and thus prevent crack growth occur in the contact region.

BRIEF DESCRIPTION OF THE DRAWINGS

A more complete appreciation of the invention and many of the attendant advantages thereof will be readily obtained as the same becomes better understood by reference to the following detailed description when considered, without limitation of the general idea of the invention, in connection with the following drawings, wherein.

DESCRIPTION OF THE PREFERRED EMBODIMENTS

Figure 1:
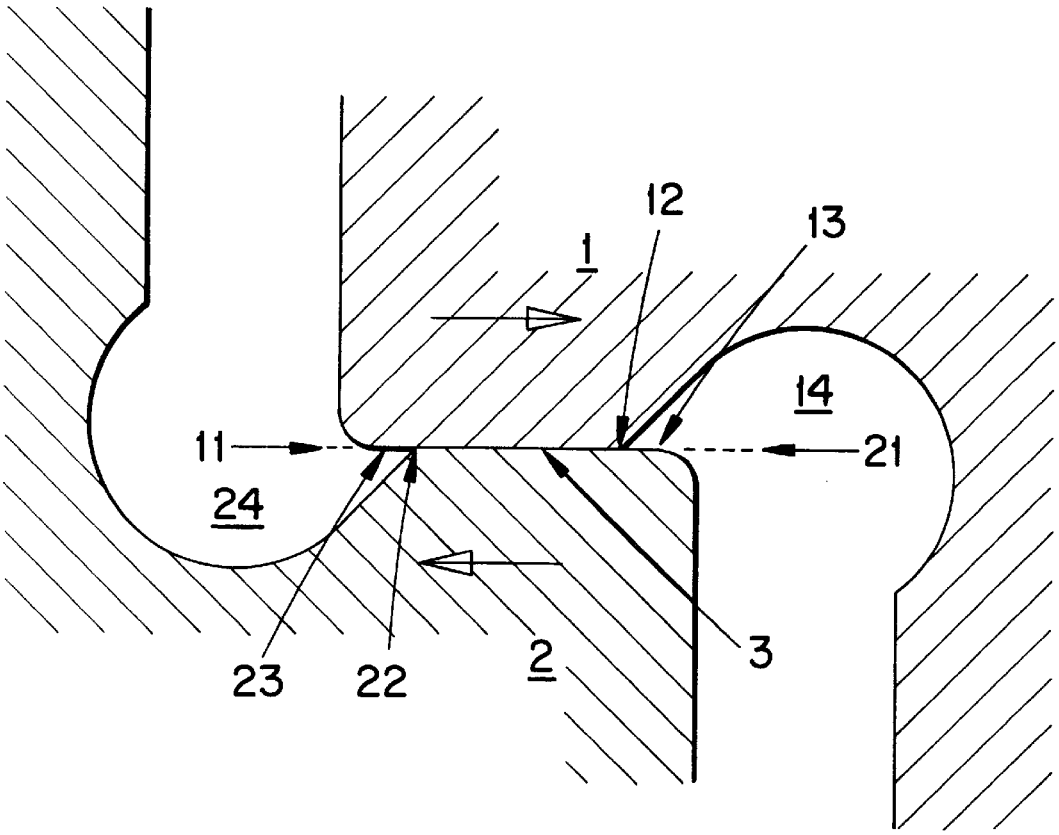
FIG. 1 shows a diagrammatic cross-section through an exemplary embodiment of a joint according to the invention between two joint partners.
Figure 2A:
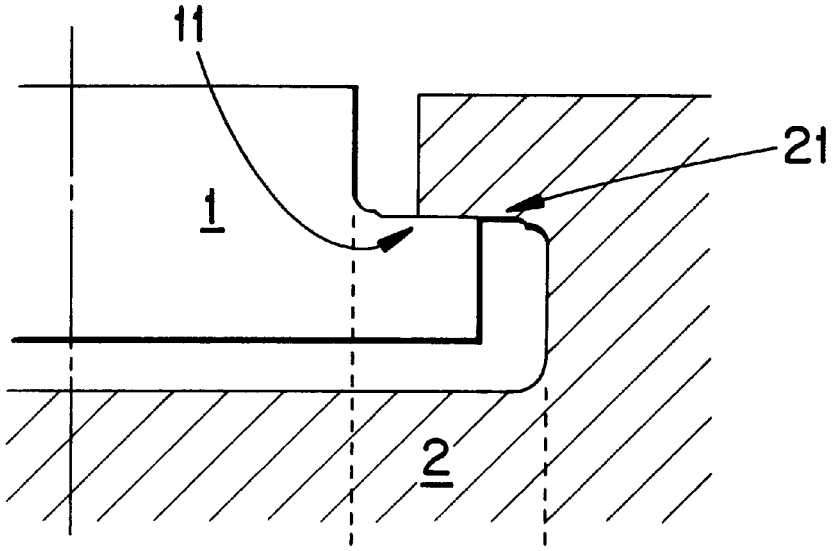
Fig. 2a PRIOR ART
FIG. 2*a* shows a diagrammatic cross-section through a joint known per se.
Figure 2B:
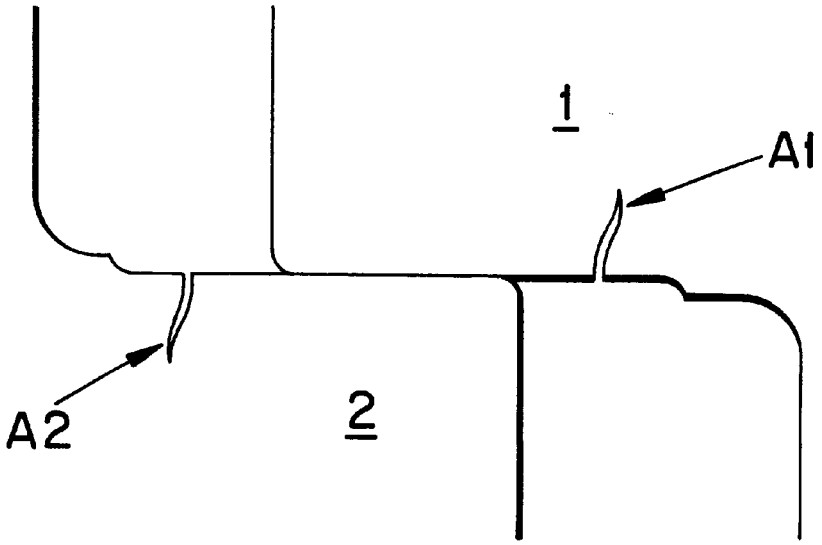
Fig. 2b PRIOR ART
FIG. 2*b* shows a diagrammatic cross-section in accordance with FIG. 2*a,* with incipient material cracks.
Figure 2C:
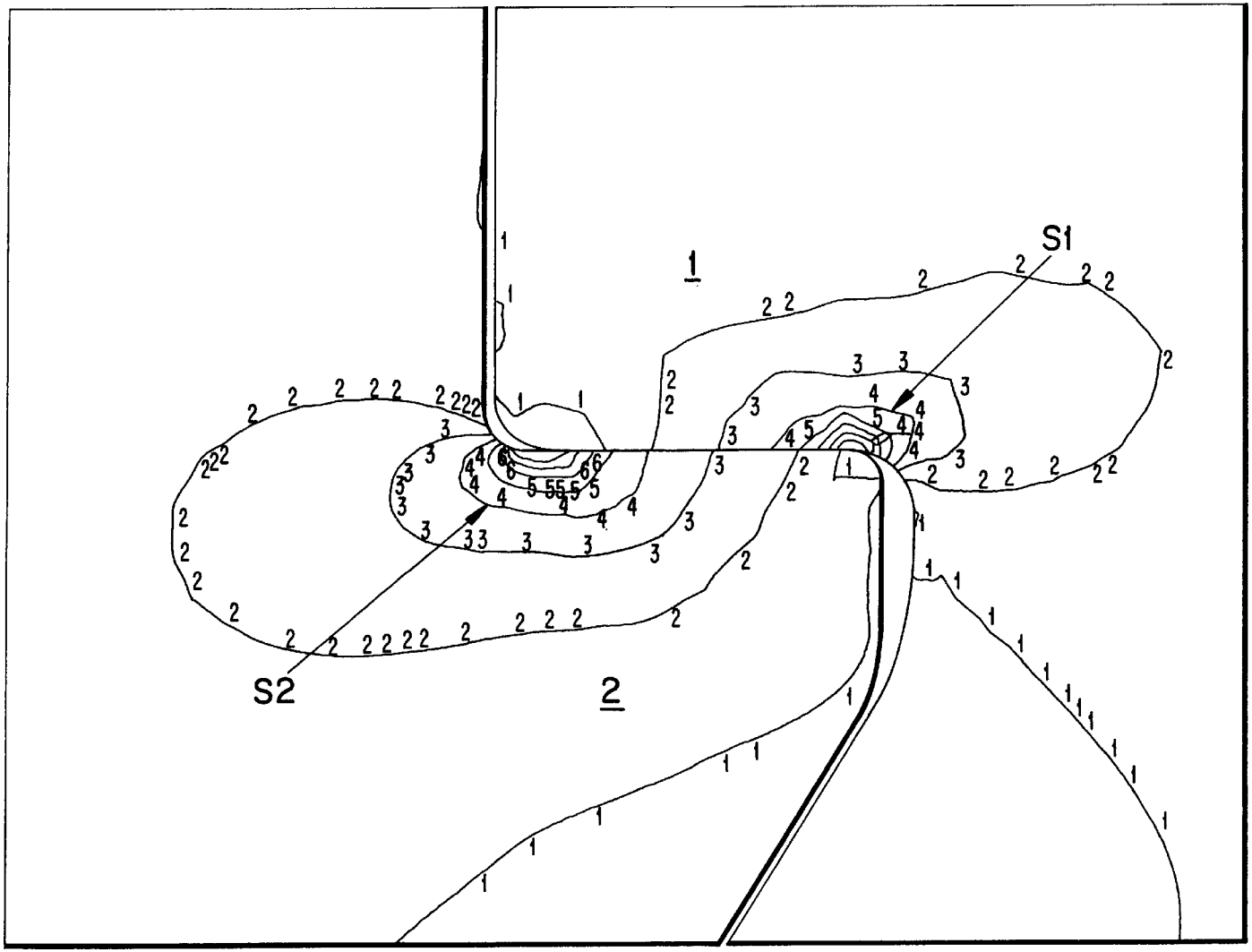
Fig. 2c PRIOR ART
FIG. 2*c* shows a diagrammatic cross-section through a joint known per se, with stress profiles.

Referring now to the drawings, wherein like reference numerals designate identical or corresponding parts throughout the several views, FIG. 1 represents an advantageous embodiment of a joint according to the invention, in accordance with which a joint partner 1 is slidingly joined along its flat, cylindrical or conical surface section 11 over a common bearing surface 3 to a flat, cylindrical or conical surface section 21 of a joint partner 2. The joint partner 1 is configured in such a way that the bearing surface 3 in the example shown provides on one side an undercut 12 in the form of a transitional edge which is shaped outwards angularly and joins the flat surface section 11 to an undercut structure 14 of concave configuration. The joint partner 2 is correspondingly constructed, and likewise has on one side an undercut 22 which joins the flat surface section 21 to the undercut structure 24, which is shaped outwardly concavely.

The joint according to the invention, which provides a joint between the joint partners 1 and 2 which is subjected to force and is slidingly supported, has a bearing surface 3 via which the two joint partners make a physical joint which is bounded in the case of all relative movements and installation tolerances to be expected by the undercut 12 of one joint partner 1, in one direction, and by the undercut 22 of the other joint partner 2, in the opposite direction.

In the exemplary embodiment shown, the flat surface sections 11 and 21 project beyond the undercuts 12 and 22 with their surface regions 13 and 23, respectively. In particular, the surface regions 13 and 23 should project beyond the undercuts 12 and 13 in each operating state of the joint, which is subjected to mechanically and thermally induced relative movements of the joint partners 1 and 2, that is to say the surface regions 13 and 23 always contribute to a positive overlapping of the ends of the respective load-bearing zone of one joint partner through the unloaded end of the other joint partner.

It is possible owing to the configuration of the joint partners according to the invention for the zones of maximum stress gradient to be shifted into the region of the rear structures 14 and 24, and for crack-opening, surface-parallel stresses to be avoided.

Figure 3:
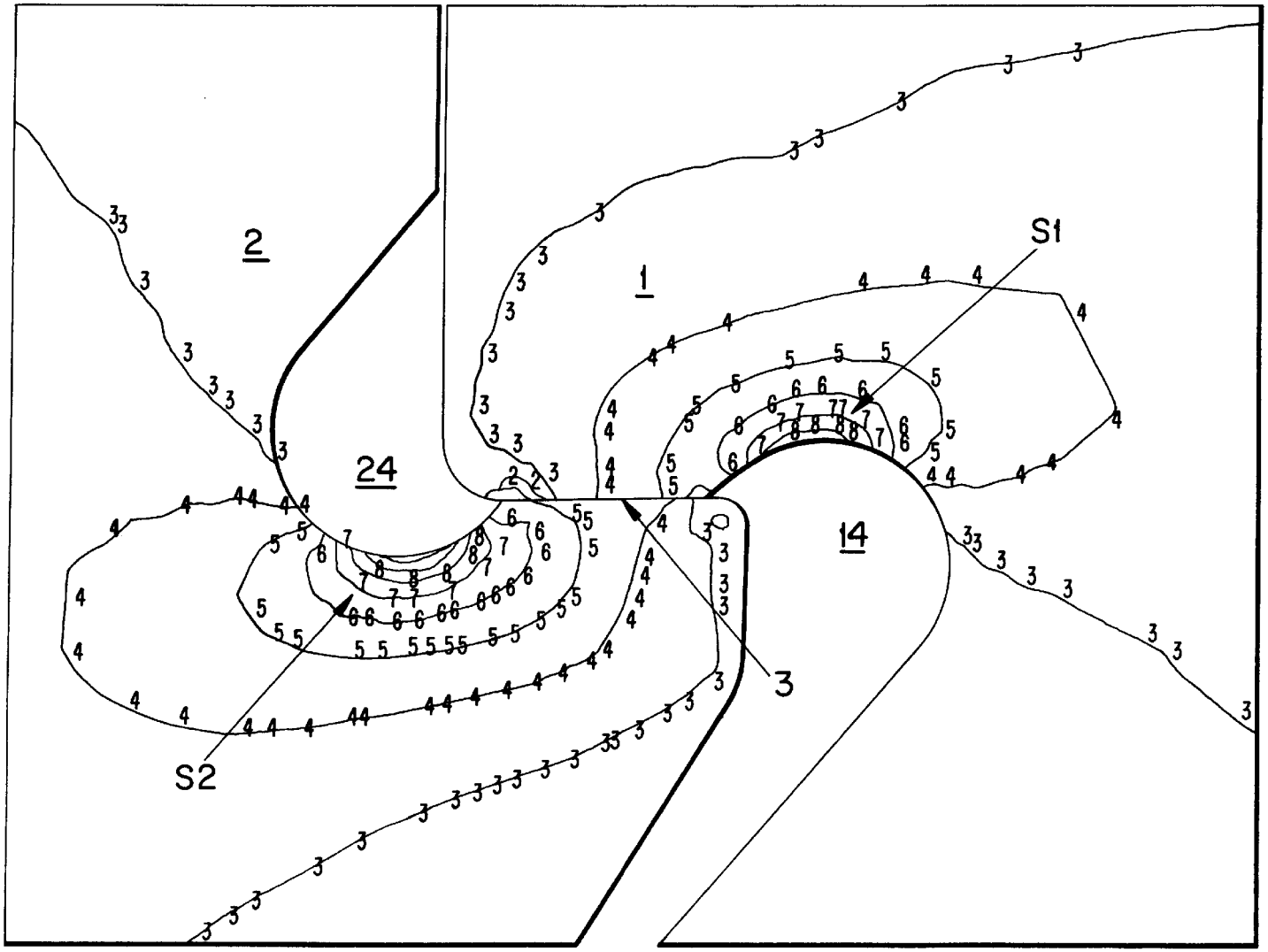
FIG. 3 shows a diagrammatic cross-section through an exemplary embodiment of a joint according to the invention, with stress profiles.

A typical cross-section through a joint according to the invention between the joint partners 1 and 2, with stress profiles drawn in, emerges from FIG. 3. Thus, in the exemplary embodiment shown in accordance with FIG. 3, the zones with maximum stress gradients 15 and 25 are situated in the region of the undercut structures S1 and S2. In the region of the bearing surface 3, by contrast, there is an only weakly varying stress gradient and, additionally, surface-parallel pressure stresses, with the result that the growth of incipient surface cracks is prevented in the bearing surface 3.

Of course, in addition to the exemplary embodiment shown in FIG. 1, it is also possible to conceive joint partner geometries having two undercuts extending in parallel, but this is a measure which is to be taken at will, depending on the application. Again, it is conceivable for the bearing surface to be completely bounded by undercuts, with the result that two pairs of undercuts which are respectively arranged orthogonal to one another are provided in each case.

Figure 4:
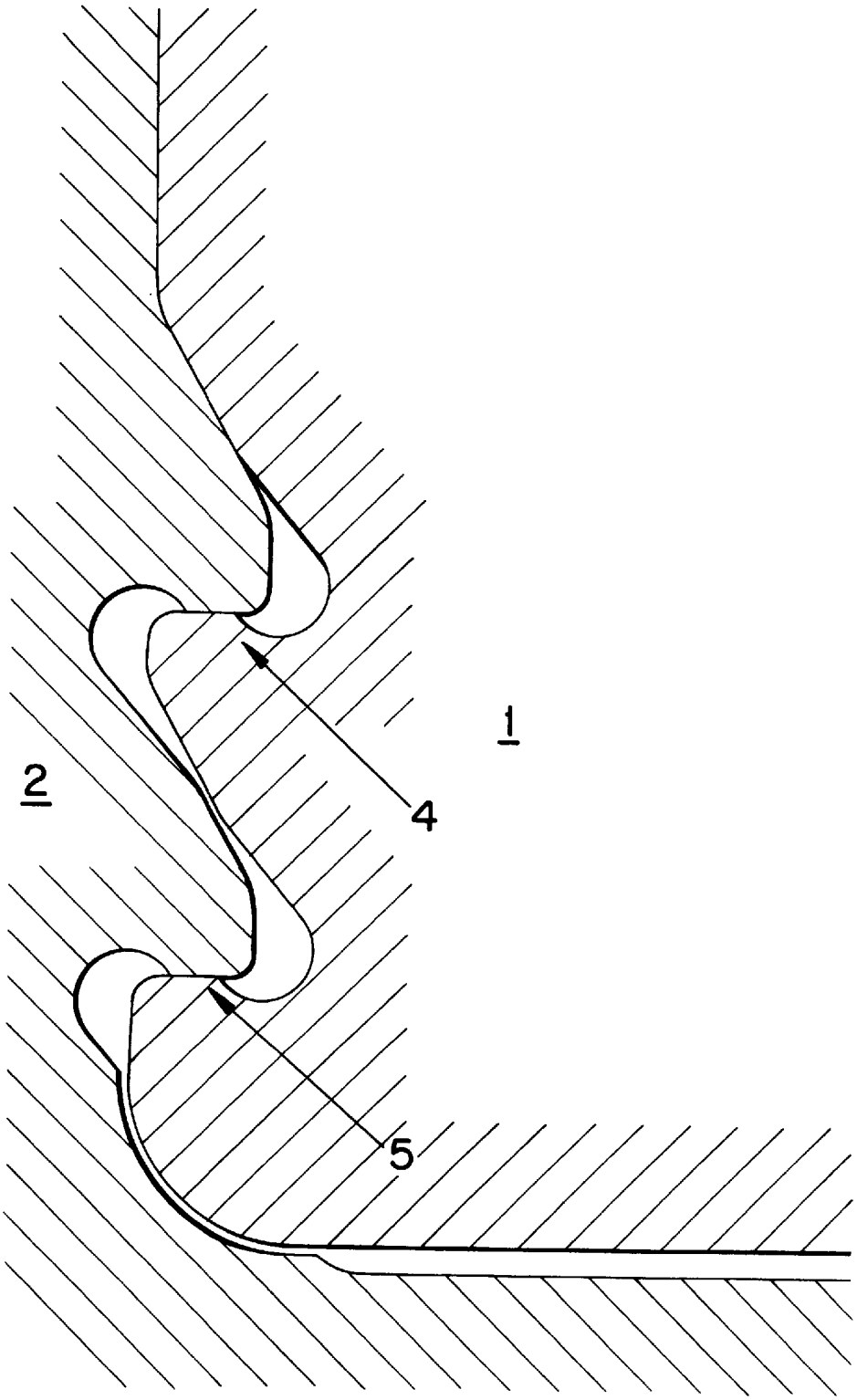
FIG. 4 shows a partial section through the joint region of a gripping pin of a turbine blade in a holding rail of a rotor housing.

FIG. 4 represents an exemplary embodiment with two joints 4 and 5 according to the invention between the joint partners 1 and 2. The exemplary embodiment shown shows a part of a gripping pin—corresponding to the joint partner 1—of a turbine blade which is introduced into the opening slot of a rotor housing—joint partner 2. The individual undercut structures are toroidally constructed in the exemplary embodiment shown.

Obviously, numerous modifications and variations of the present invention are possible in the light of the above teachings. It is therefore to be understood that within the scope of the appended claims, the invention may be practiced otherwise than as specifically described herein.

What is claimed is:

1. A joint between two joint partners comprising: a first and a second joint partner, each joint partner including at least one flat, cylindrical surface section via which force is applied to the other joint partner, the joint partners being brought into contact with one another in a sliding fashion such that the flat, cylindrical surface sections of the joint partners partially overlap and form a common bearing surface in a contact region, the flat, cylindrical surface sections of the joint partners are each bounded on one side by at least one undercut, the joint partners are joined such that the common bearing surface of the joint partners is bounded in one direction by the undercut of the first joint partner and in an opposite direction by the undercut of the second joint partner.

2. The joint as claimed in claim 1, wherein a surface region of the flat, cylindrical surface section of the first joint partner overlaps the undercut of the second joint partner.

3. The joint as claimed in claim 1, wherein the undercut of each of the first and second joint partners is constructed as a transitional edge and joins the flat, cylindrical surface section of each respective joint partner to a undercut structure including a concave bulge.

4. The joint as claimed in claim 3, wherein the transitional edge has a round or angular shape.

5. The joint as claimed in claim 4, wherein the undercut structure has at least one toroidally shaped region.

6. The joint as claimed in claim 1, wherein the undercuts of the joint partners extend in a parallel fashion in pairs.

7. The joint as claimed in claim 1, wherein the undercuts of the joint partners are orientated substantially perpendicular to a direction of a relative sliding movement of the joint partners.

8. The joint as claimed in claim 1, wherein the joint is implemented as a plug-in joint between moving or stationary machine parts for compensating relative movements between the machine parts and for avoiding material cracks on the common bearing surface.

9. The joint as claimed in claim 8, wherein the machine parts are centering seats or blade suspensions of turbine blades into which correspondingly shaped seating fits of turbine blades can be inserted.

10. The joint as claimed in claim 1, wherein a surface region of the flat, cylindrical surface section of the second joint partner overlaps the undercut of the first joint partner.

* * * * *